US005412552A

United States Patent [19]

Fernandes

[11] Patent Number: 5,412,552

[45] Date of Patent: May 2, 1995

[54] LIGHTING LAMP BAR

[76] Inventor: Mark Fernandes, P.O. Box 197164, Louisville, Ky. 40259

[21] Appl. No.: 217,486

[22] Filed: Mar. 24, 1994

Related U.S. Application Data

[63] Continuation-in-part of Ser. No. 6,366, Mar. 25, 1993.

[51] Int. Cl.[6] ..... F21V 21/14

[52] U.S. Cl. ..... 362/250; 362/249; 174/68.3; 174/101

[58] Field of Search ..... 362/249, 250; 174/68.3, 174/101

[56] References Cited

U.S. PATENT DOCUMENTS

| | | | |
|---|---|---|---|
| 1,962,554 | 6/1934 | Mask . | |
| 3,061,810 | 7/1960 | Boyd . | |
| 3,308,416 | 3/1967 | Boyd . | |
| 3,391,377 | 7/1968 | Corl et al. . | |
| 3,801,951 | 4/1974 | Kemmerer et al. . | |
| 4,655,520 | 4/1987 | Cummings . | |
| 4,748,548 | 5/1988 | Barton . | |
| 4,858,088 | 8/1989 | Agabekou | 362/249 |
| 5,031,083 | 7/1991 | Claesson . | |
| 5,235,136 | 8/1993 | Santucci et al. | 174/101 |

*Primary Examiner*—Carroll B. Dority
*Attorney, Agent, or Firm*—Middleton & Reutlinger; David W. Carrithers

[57] ABSTRACT

An electrical strip assembly providing a light fixture supporting main body having a plurality of electrical outlets.

4 Claims, 5 Drawing Sheets

LIGHTING LAMP BAR

This application is a Continuation-In-Part of U.S. patent application Ser. No. 29/006,366 pending filed on Mar. 25, 1993.

This invention relates to a lighting system having lighting fixtures which are selectively attachable and slidable within a track-like support and electrical connector assembly.

Conventional lighting systems have been developed utilizing a "track" arrangement in which a conductor assembly, enclosed in or formed in a track, enables the placement of any number of a plurality of fixtures at any one of a number of locations along the track. Such systems are referred to as track lighting systems and have the advantage of being able to place illumination where needed without complete rewiring behind fixed partitions, walls and ceilings. Such systems have been utilized in commercial, office manufacturing, and retail establishments where flexibility of positioning of lighting sources is important as the need arises for relocation of displays, equipment or walls.

Track lighting systems typically suspend lighting fixtures below a track or rail in a downwardly facing channel such as disclosed in U.S. Pat. No. 3,801,951 are commercially available; however, these track lighting systems are typically unsightly in appearance and usually sacrifice the strength of the track assembly in order to minimize the structure exposed to the user.

Track lighting assemblies known in the art consist of housing members having holes formed through the sides thereof at selected positions along the longitudinal axis whereby a plurality of wiring harnesses extend through one end of the housing, and individual designated wiring harnesses are separately projected through the selected holes as trunk lines extending from the main mass of wires. When a light is not needed the mass of wires extending from the designated hole provide an unsightly mess. If all of the unused lamps are left attached to the lamp bar, the lamp bar is unnecessarily heavy, difficult to position, and ties up unused equipment.

The lighting lamp bar of the present invention utilizes individual plug receptacles and connectors which fit flush within the connector strip providing a smooth, neat appearance and providing a quick disconnect means for each of the stagelight plug connectors. The wire harness to each of the plug connectors has been simplified and need not be removed as in conventional track lighting systems. If additional plug connectors are required in a lamp bar which is already securely held into position, the connector strip can simply be removed so that additional plug connectors can be fitted therein and the wires connected to a central connector.

Moreover, the present invention provides a lighting lamp bar assembly having a pleasing appearance of a tubular frame fabricated from high a strength lightweight material such as aluminum while maintaining the rigidity and structural strength required for supporting heavy lighting assembly such as stage lights. Furthermore, the present invention combines a main body structure have a downwardly facing channel for supporting the light fixtures combined with a strip or longitudinal member having a plurality of outlets or sockets therein mounted along one side of the main body adapted for quick changing of the lights mounted thereon utilizing conventional plug outlets. The length of the lamp bar, number of light fixtures supported thereby, and number of receptacles in the strip are easily changeable due to the quick disconnect and assembly system disclosed herein.

SUMMARY OF THE INVENTION

The present invention is a longitudinal lamp bar having a recess for receiving the heads of bolts for supporting lighting fixtures on the underside thereof and a flat longitudinal strip connector running along one side of the main body for electrical connection of the lighting fixtures. An aluminum barrel bushing is also provided for electrical connection. The longitudinal strip is removable, and is pivotally attached but affixed by a holding means such as a screw.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
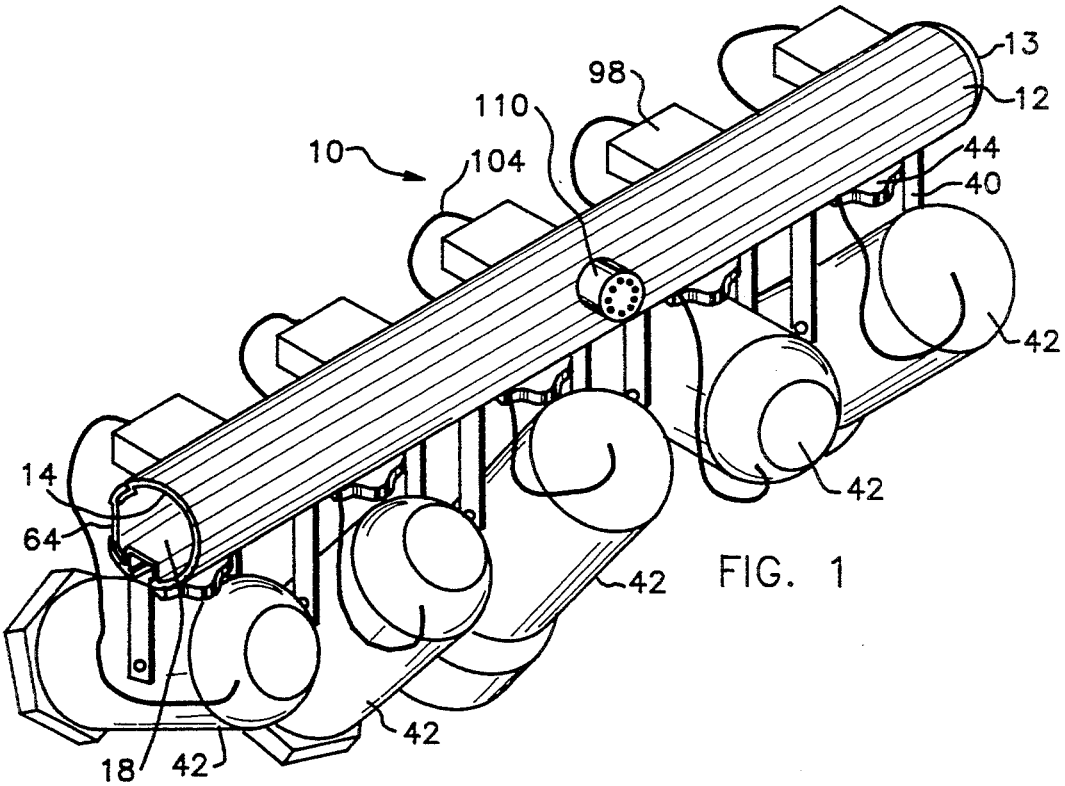
FIG. 1 is a perspective view of the present invention showing a plurality of stage lights suspended from the lighting lamp bar and an quick connect electrical connector extending therefrom.

The lighting lamp bar of the present invention is manufactured from readily available materials and simple in design. The preferred embodiment is comprised of metal, more particularly aluminum due to its light weight and great structural strength. However, it is contemplated that plastic, such as high density polyethylene, nylon, PVC, a polymer composite containing graphite or aramid fibers, or any type of metal such as steel or copper could be used in combination with or substituted for the aluminum components of the present invention.

Referring now to the drawings, FIGS. 1–4 show the lighting lamp bar 10 designed to be connected to an existing frame or be suspended from the ceiling and support a plurality of stagelights 14 or alternative light sources. The preferred embodiment shown in FIG. 1, includes a plurality of spaced apart grooves extending longitudinally along the external surface thereof; however, the grooves are formed therein for aesthetic purposes to provide a pleasing appearance and are not a functional feature.

As shown in FIGS. 1–4, the lighting lamp bar assembly 10 of the preferred embodiment is fabricated from one or two extruded members forming a generally cylindrical housing 12. The housing 12 includes a "C-shaped" tubular main body support member 14 forming a longitudinal recessed conduit 16 therein. An end plate 13 is provided at each end of the housing 12 for sealing he ends of the housing 10 and providing a more aesthetic appearance to viewers. An inverted trough 18 is formed "extruded" integrally as a part of the tubular support member 14. The inverted trough 14 extends inwardly from the inner wall 20 into the recessed conduit 16 and extending longitudinally along the bottom of the tubular main body support member 14. The inverted trough 14 is recessed in order that the housing 12 maintain a smooth, generally cylindrical appearance. The inverted trough 14 includes a first side wall 22 and a second side wall 24 joined by a top cover 26. The outer wall 28 of the tubular support 14 continues to extend beyond the side walls 22, 24 forming a pair of aligned opposing flanges 30 extending normal to the longitudinal axis formed integrally therein, extending longitudinally along the bottom of the main body support member 14 forming a slot or "C-shaped channel 32 therealong. The "C-shaped" channel 32 are complementary sized and shaped to slidably support and secure the a holding means, such as the head 34 of a support member, such as a bolt, preferably threaded machine bolt 36 so that the head will not rotate within in the "C-shaped" channel 32. The bolt 36 extends downward, outwardly from and perpendicular to the tubular main support member 14 for extend through a hole 38 formed in the top of a support bracket 40 for supporting a stagelight 42 or other device.

Figure 2:
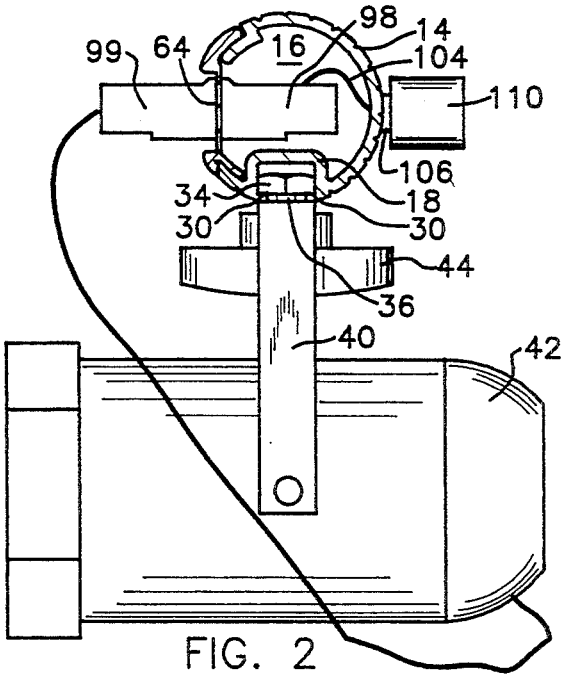
FIG. 2 is a side view of FIG. 1.
Figure 4:
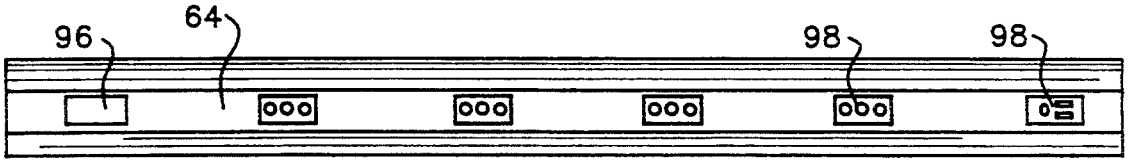
FIG. 4 is a bottom plan view showing the electrical strip assembly.

As best shown in FIG. 2, a generally "U-shaped" bracket 40 is pivotally attached to the housing of the stagelight by holding means such as bolts, screws, rivets, or the like, and the bracket 40 is rotatably secured between a knob 44, having a threaded nut formed therein which threadably engages the bolt 36, used to rotatably support the stagelight 42 and tighten the lamp bracket 40 to hold the stagelight 42 in the desired orientation.

Figure 3:
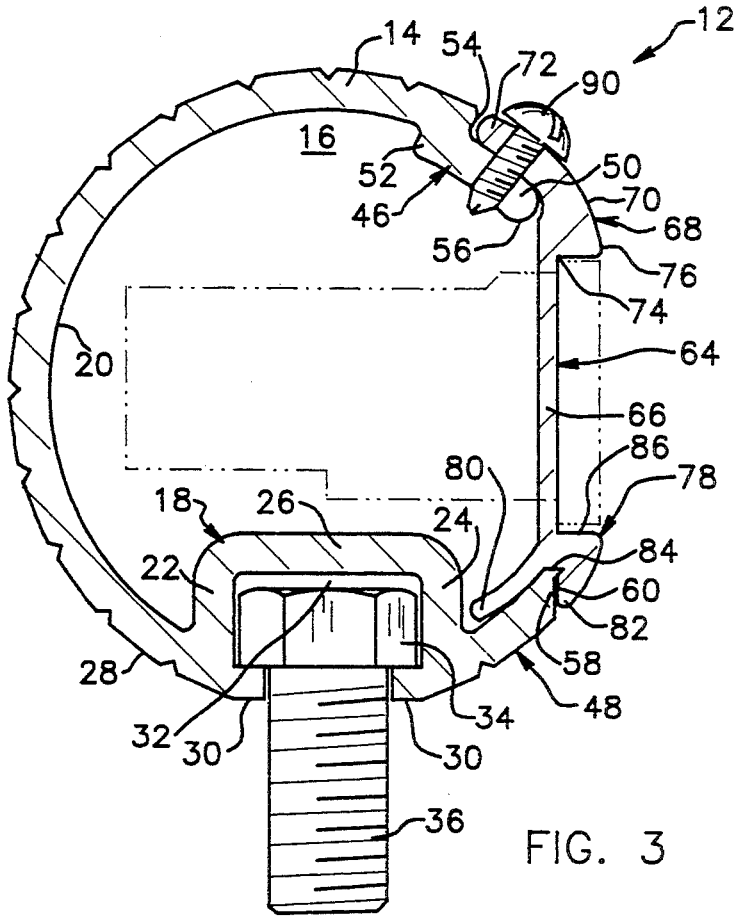
FIG. 3 is an enlarged side view of the lighting lamp bar showing the electrical strip having a socket shown in phantom lines extending into the main body of the support bar and showing a light attachment bolt slidably mounted within a channel formed into the base of the support bar.

FIG. 3 is a side view of the preferred embodiment showing the "C-shaped" tubular main body member 14 formed having a first end projection forming an upper lip 46 and a second end projection forming a lower lip 48. The upper and lower lips 46 and 48 respectfully extend toward one another a short distance and follow the same general cylindrical curvature of the tubular body member 14. The upper lip 46 is recessed slightly within the longitudinal recess conduit 16 forming a support step 50 having an inner shoulder 52 and an outer shoulder 54 and a rounded distal end 56. The distal end 58 of the lower lip 48 is angled upwardly forming a vertical support surface 60 having a short outwardly angled projection 62 which extends inwardly horizontally to the inner wall 20 of the lower lip 48.

FIGS. 1–5 show the lighting lamp bar 10 having a generally flat longitudinal strip connector 64 extruded from aluminum which fits in sliding cooperative relationship with the upper lip 46 and lower lip 48 of the tubular main body support 14 via a tongue and groove arrangement.

The strip connector 64 has a flat central portion 66 connecting an upper projecting lip 68 having a curved outer surface 70 complementary shaped with respect to the tubular support member 14 and a rounded distal end 72. A step 74 extending outwardly from the central portion 66 forms an upper support shoulder 76 connecting the lip 68 with the central portion 66.

The strip connector 64 includes a lower projecting split lip 78 having a curved inner projection 80 spaced apart from a short curved outer projection 82 by a short horizontal segment 84. The curved outer projection 82 is complementary sized and shaped with respect to the tubular support member 14. The exterior portion of the lower lip 78 connected to the flat central portion 66 forms a step 86 having a lower support shoulder 88.

The curved inner projection 80 and curved outer projection 82 of the lower projecting split lip 78 form a groove thereinbetween which cooperates in a slidable and pivotable connection with the tongue formed by projection 62, the inner wall 20, and support surface 60 of the tubular main body lower lip 48 to removably and slidably secure the strip connector 64 to the tubular main body 14. The strip 64 may be pivoted upon the lower projecting split lip 78 and/or held securely in a slidable relationship in cooperation with the support step 50 of the upper lip 46 of the tubular support member 14. The outer shoulder 54 limits the upward movement of the upper projecting lip 68 of the strip connector 64 to hold it securely in place.

The strip connector 64 may be secured from movement by a holding means such as a screw 90 extending through a hole 92 (not shown) formed through the upper lip 68 of the strip connector 64 and a hole 94 (not shown) formed through the upper lip 46 of the tubular support member 14. The strip connector 64 may be hingably removed from the tubular main body support 14 or the screws 90 may be loosened so that the strip connector 64 can slide along the longitudinal axis of the tubular main body 14.

Figure 5:
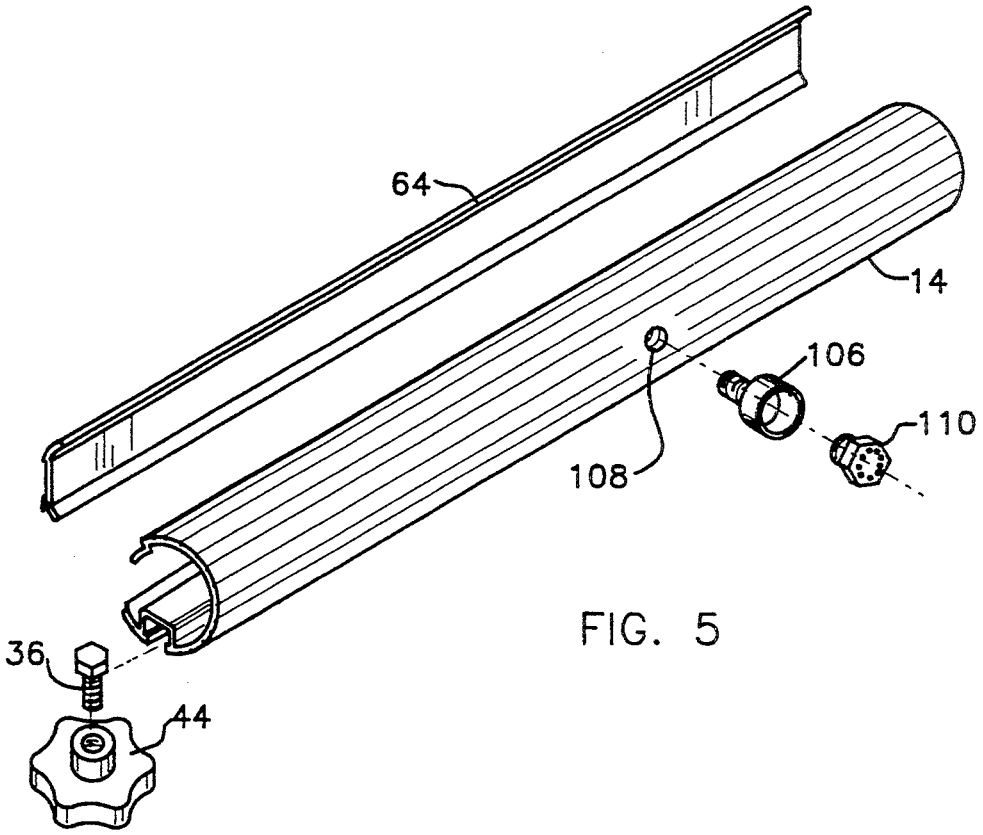
FIG. 5 is an exploded perspective view showing the support bar, strip assembly, electrical connector, and light attachment device.

As shown in FIGS. 1–4, a plurality of openings 96 are cut, stamped, or formed as knock-outs in selected locations along the strip connector 64. Plug connectors or electrical receptacles 98 having a generally rectangular shape are inserted through the openings 98 of the strip connector 64 so that the main body 102 of the receptacles 98 is disposed within the longitudinal recessed conduit 16 of the main tubular body 14. The receptacles 98 may be marked for easy identification as a safety consideration. Mating plugs 99 from the stagelights 42 simply cooperatively engage the receptacles 98. The outer face or flange 100 of the receptacles 98 are of a larger dimension than the receptacle body 102 and fit flush with the flat surface of the strip connector 64. The wires 104 from the receptacles 98 extend thorough the recess conduit 16 to an aluminum barrel bushing 106, as best shown in FIGS. 1 and 5, which is press fitted into position within an opening 108 formed through the wall 20 of the main tubular body 14, usually opposite the strip connector 64. The preferred embodiment of the present invention utilizes a 19 pin central connector 110 is recessed into the bushing 106. The individual wires extending through the main tubular body 14 to each of the plug connectors 98 which are in turn connected to the pin connector assembly 110. Wires (not shown) leading from the pin connector assembly 110 are connected to the light power source which may be a computerized control system to control the intensity and color of the light omitted by the stagelamps 42.

The individual plug receptacles 98 and connectors 110 which fit flush within the connector strip 64 providing a smooth, neat appearance and providing a quick disconnect means for each of the stagelight plug connectors 99. The wire harness to each of the plug receptacles 98 has been simplified and need not be removed as in conventional track lighting systems. If additional plug receptacles 98 are required in a lighting lamp bar assembly 10 which is already securely held into position, the connector strip 64 can simply be removed so that additional plug receptacles 98 can be fitted therein and the wires connected to a central connector 110.

The plurality of receptacles 98 mounted within the tubular main body 14 and extending along one side of the main body 14 are adapted for quick changing of the lights 42 mounted thereunder utilizing conventional plug receptacles 98. The length of the lighting lamp bar 10, number of light fixtures 42 supported thereby, and number of receptacles 98 in the strip connector 64 are easily changeable due to the quick disconnect and assembly system.

Figure 6:
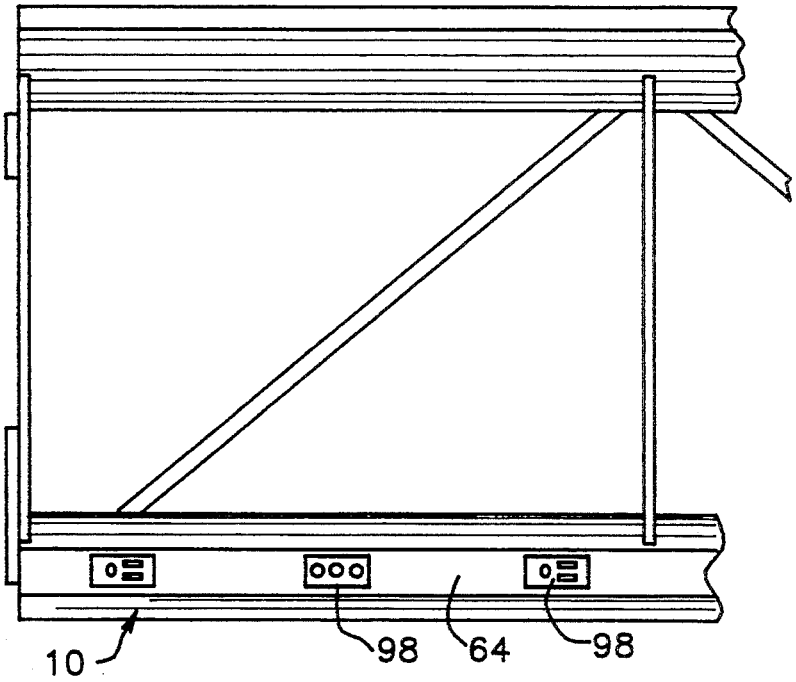
FIG. 6 is a front plan view of the light lamp bar of the present invention mounted to support frame.
Figure 7:
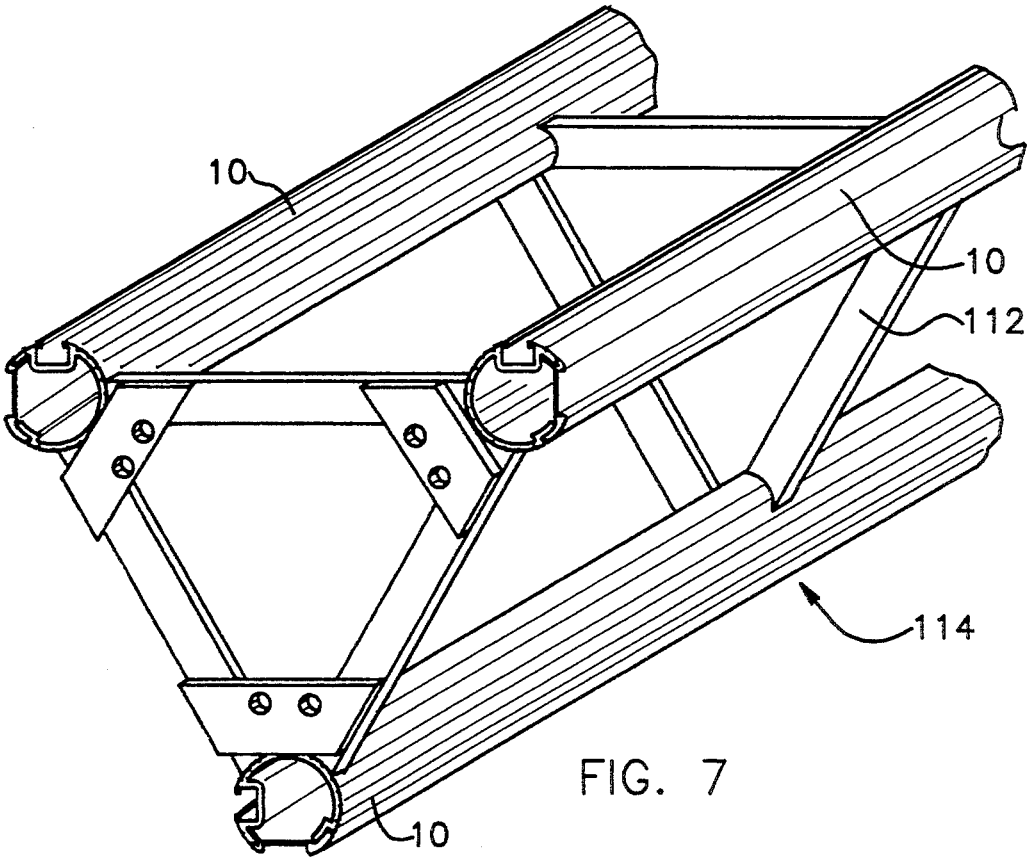
FIG. 7 is an elevated side view of three light lamp bars for the present invention being utilized as a self supporting truss.
Figure 9:
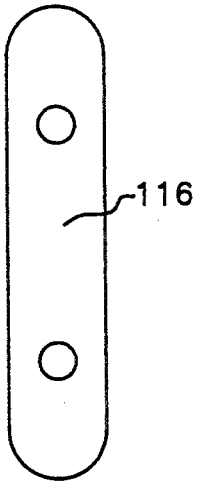
FIG. 9 is an elevated front plan view showing an end plate adaptable for use with the truss shown in FIG. 8.

The lighting lamp bar assembly 10 may be suspended from an existing support frame such as shown in FIG. 6, or several of the lamp bars 10 may be connected together by struts 112 to form an independently supported longitudinal, horizontal or angled triangular truss 114, such as is shown in FIG. 7, having stagelamps 42 (not shown) which may be directed in any direction.

Figure 8:
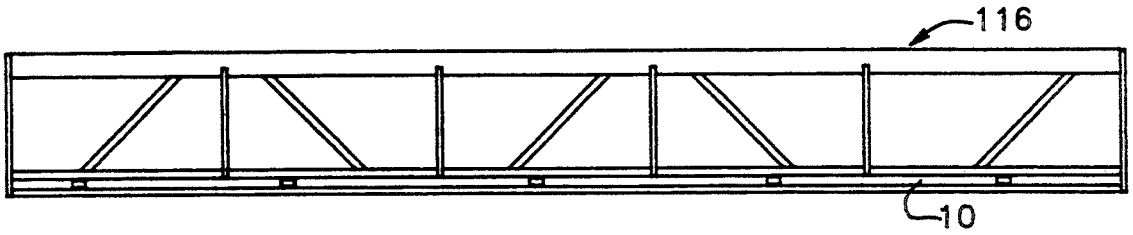
FIG. 8 is a elevated front plan view of a truss formed utilizing a lamp bar as a support member.
Figure 10:
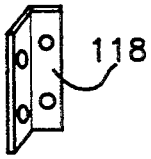
FIG. 10 is an elevated perspective view showing a connector for angling and connecting lamp bar truss.

An "I-truss", square truss, or other such support may also be constructed using the lighting lamp bar 10 as a structural component thereof, such as is shown in FIG. 8, wherein the lamp bar 10 forms the base of a truss 114 having an end plate 116 may be adapted to provide a slim profile to the support. Moreover, two or more truss 114 may be combined and connected together at their distal ends by an angled connection means 118, such as shown in FIG. 10 which may be constructed for angles having a range of about 30 to about 90 degrees, and preferably for angles or 30, 45, 60, and 90 degrees.

Figure 11:
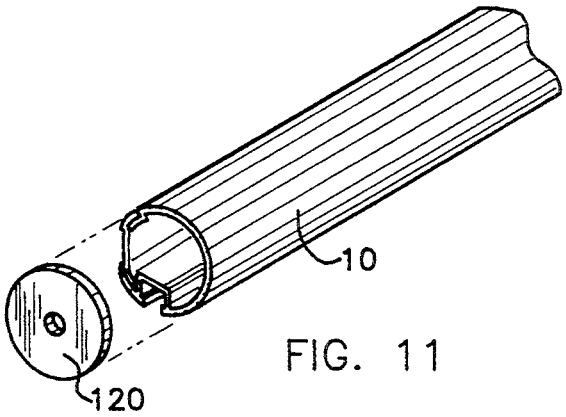
FIG. 11 is an elevated perspective view showing a lighting lamp bar showing an end cap support.
Figure 12:
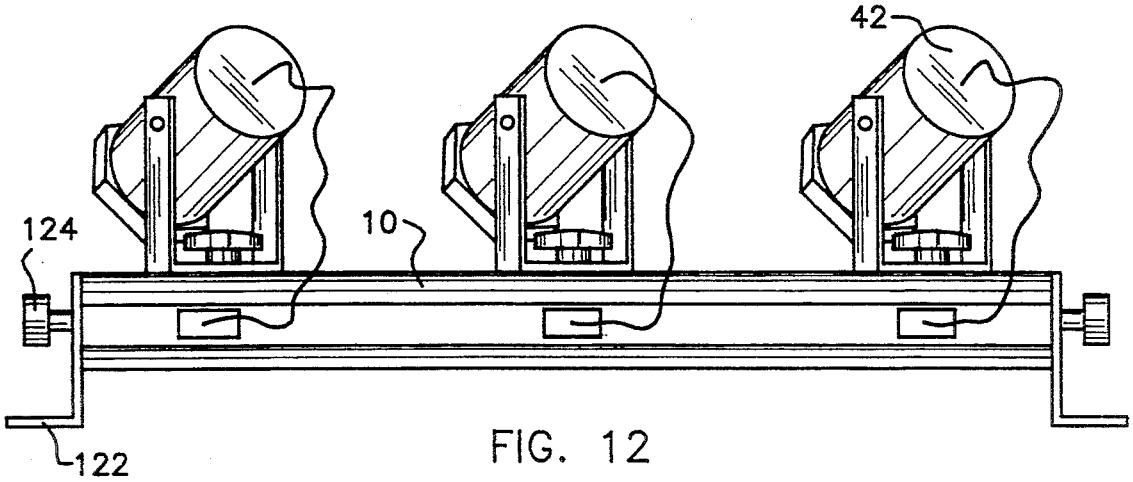
FIG. 12 is an elevated perspective view showing a floor mounting lighting lamp bar.

An alternate embodiment is shown in FIGS. 11 and 12, wherein an end plate having a hole therein 120 is attached to the distal end of the lighting lamp bar 10 and supported from a flat surface such as a floor with a bracket, preferably a "L-shaped" brackets or a triunion 122 having a connecting holding means such as a bolt 124 for pivotally supporting and directing stagelights 42 upwardly.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A lighting lamp bar, comprising:

a "C-shaped" tubular main body support member having a longitudinal recessed conduit therein, an inverted trough formed integrally therein extending inwardly into said recessed conduit and extending longitudinally along the bottom of said tubular main body support member, said inverted trough having a pair of aligned opposing flanges extending normal to the longitudinal axis formed integrally therein and extending longitudinally along the bottom of the main body support member forming a "C-shaped channel therealong, said "C-shaped" channel being complementary sized and shaped to slidably support and secure a light holding means, and a generally flat longitudinal strip connector in sliding communication with said tubular main body support.

2. The lighting lamp bar of claim 1, wherein said holding means comprises a bolt cooperatively engaged therewith so that the head will not rotate within the "C-shaped" channel for supporting a stagelight.

3. The lighting lamp bar of claim 1, wherein said strip connector cooperatively engages said main tubular body using a tongue and groove arrangement.

4. The lighting lamp bar of claim 1, wherein said strip connector comprises a flat central portion connecting an upper projecting lip having a curved outer surface complementary shaped with respect to the tubular support member and a rounded distal end, said upper lip having a step extending outwardly from said flat central portion forming an upper support shoulder connecting said upper lip with said flat central portion.

* * * * *